US007444096B2

(12) United States Patent
Lowman et al.

(10) Patent No.: US 7,444,096 B2
(45) Date of Patent: Oct. 28, 2008

(54) ELECTRONIC DEVICE POWER SUPPLY

(75) Inventors: Bradley M. Lowman, Meridian, ID (US); Michael C. Muthart, Boise, ID (US); Andrew R. Smith, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/092,650

(22) Filed: Mar. 29, 2005

(65) Prior Publication Data

US 2006/0222397 A1 Oct. 5, 2006

(51) Int. Cl.
*G03G 15/00* (2006.01)

(52) U.S. Cl. ..... 399/88; 399/77

(58) Field of Classification Search ..... 399/77, 399/88, 90, 320, 324; 340/309.16–309.9
See application file for complete search history.

(56) References Cited

U.S. PATENT DOCUMENTS 2,802,153 A * 8/1957 Bonn
2,999,191 A * 9/1961 Vazgen et al.
3,444,455 A * 5/1969 Johnson et al.
3,820,141 A * 6/1974 Aizawa et al.
3,944,360 A 3/1976 Deetz et al.
4,615,609 A * 10/1986 Honma ..... 399/88
4,907,249 A 3/1990 Nebel
4,930,393 A * 6/1990 Castro, Jr.
5,200,780 A * 4/1993 Koichi
5,457,516 A 10/1995 Kim
5,636,332 A * 6/1997 Hibino
5,640,646 A * 6/1997 Toyohara et al.
5,923,919 A 7/1999 Nimura et al.
6,134,401 A 10/2000 Yun et al.
7,110,685 B2 * 9/2006 Shin
2003/0048323 A1 3/2003 Kaburagi
2004/0027400 A1 2/2004 Ryu et al.
2005/0019049 A1 * 1/2005 Shin

OTHER PUBLICATIONS

Jeff Tyson, *How BIOS Works,* http://computer.howstuffworks.com, Undated; printed Oct. 11, 2004 (6 pgs.)
Jeff Tyson, *How Scanners Work,* http://computer.howstuffworks.com, Undated; printed Oct. 11, 2004 (9 pgs.)
Jeff Tyson, *How PCs Work,* http://computer.howstuffworks.com, Undated; printed Oct. 11, 2004 (11 pgs.)

* cited by examiner

*Primary Examiner*—David M. Gray
*Assistant Examiner*—Laura K Roth

(57) ABSTRACT

A method and apparatus initiate the supply of power to a component to ready the component to perform a function in response to further operator input.

32 Claims, 5 Drawing Sheets

ELECTRONIC DEVICE POWER SUPPLY

BACKGROUND

Many electronic devices perform multiple preliminary processes to prepare the electronic device for use. Such preliminary processes may delay use of the electronic device. This may lead some users to maintain the electronic device in a constant ready state, consuming valuable energy.

DETAILED DESCRIPTION OF EXAMPLE EMBODIMENTS

Figure 1:
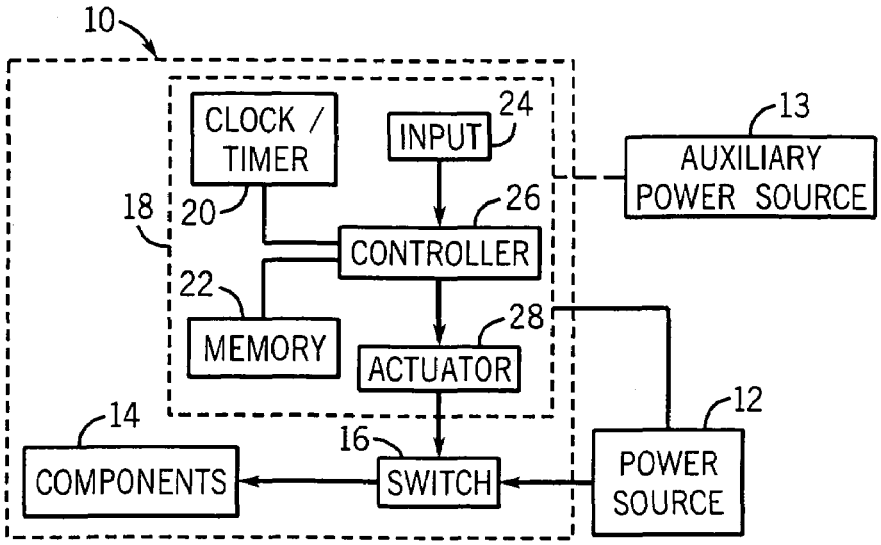
FIG. 1 is a schematic illustration of an embodiment of an electronic device according to one exemplary embodiment.

FIG. 1 schematically illustrates an electronic device 10 configured to receive power from a power source 12. In one particular embodiment, power source 12 comprises electrical current. In one particular embodiment, power source 12 comprises a source of alternating current.

Electronic device 10 generally includes electronic components 14 and power control system 18. Electronic components 14 comprise one or more components configured to perform at least one function. In one embodiment, electronic components 14 are readied prior to performing their individual functions. For example, in one embodiment, electronic components 14 may be calibrated, aligned or initialized prior to performing such functions as printing or otherwise applying a printing material, such as toner or ink, to a print media, prior to recording data to a memory media or prior to manipulating data entered by an operator. In other embodiments, electronic components 14 may additionally or alternatively be warmed or heated to a predetermined temperature or be charged to a predetermined voltage prior to displaying an image, forming an electrostatic printing material carrying image or prior to fusing printing material to a print medium.

Power control system 18 comprises a device configured to automatically initiate the supply of power to components 14 to ready components 14 for their respective functions at one or more predetermined times based upon stored values without further operator input. In one embodiment, components 14 perform their actual functions in response to further operator input after being readied. Power control system 18 generally includes clock/timer 20, memory 22, input 24, controller 26 and actuator 28. Clock/timer 20 generally comprises a time measurement device configured to measure time and to generate and transmit signals representing the passage of time to controller 26. In one embodiment, clock/timer 20 comprises a clock configured to track universal time (for example, 1:00 p.m., 6:00 a.m., 1800 hours) and to communicate the universal time to controller 26. In another embodiment, clock/timer 20 comprises a timer configured to measure the lapse or passage of time (for example, 1 hour, 15 minutes; 6 hours, 5 minutes; 30 seconds) and transmits signals representing the passage of time to controller 26. Clock/timer 20 may comprise a digital device or a mechanical device. Clock/timer 20 is powered by power received from power source 12. In other embodiments, clock/timer 20 may be powered by an auxiliary power source 13 such as a battery and the like.

Memory 22 comprises memory configured to store a time value. Memory 22 may comprise a random access memory (RAM), a EEROM memory, a mass storage device or some other persistent storage. In one particular embodiment, memory 22 is configured to store a universal time value. In another embodiment, memory 22 is configured to store an elapsed time value. Memory 22 is configured to be read or otherwise accessed by controller 26.

Input 24 comprises one or more devices configured to permit an operator or person to communicate or interface with controller 26 so as to input a time value such as a universal time value or an elapsed time value. In one embodiment, input 24 may comprise a keyboard. In another embodiment, input 24 may comprise a mouse, a microphone, a dial, a push button, a touch screen which may also serve as a display, and the like. Although input 24 is illustrated as being physically part of electronic device 10, such as part of a control panel, input 24 may alternatively be physically separate from electronic device 10 but capable of communicating with controller 26. For example, in other embodiments, input 24 may comprise a keyboard, mouse, push button, dial, keyboard and the like provided on a distinct electronic device which is in communication with controller 26 via an internet connection, a network connection, a wired, infrared or radio frequency connection and the like. Input 24 enables a person or operator to enter a desired time value at which components 14 are to be readied or at which the initiation of the process of readying components 14 by the transmission of power to components 14 is to start.

Controller 26 comprises a processing unit. For purposes of the disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 26 is not limited to any specific combination of hardware circuitry and software, nor to any particular source for the instructions executed by the processing unit.

Controller 26 is configured to generate control signals for directing actuator 28 to actuate switch 16 between the on or power transmitting state and the off state based upon the time value stored in memory 22 and the time as measured and indicated by clock/timer 20. In particular, controller 26 is configured to receive the electrical signals from clock/timer 20 indicating a measured time value, such as a universal time value or an elapsed time value. In one embodiment, controller 26 periodically polls clock/timer 20 for this information. Controller 26 then reads memory 22 and compares the stored time value to the measured time value from clock/timer 20. When such values are equal, controller 26 generates control signals directing actuator 28 to actuate switch 16 to the on state.

In the particular embodiment illustrated, controller 26 is further configured to receive input signals representing a time value to be stored in memory 22 from input 24. Controller 26 is further configured to write and store the data received via input 24 in memory 22. In other embodiments, a separate or distinct processor or other device may be used to write or store such time values in memory 22.

In one embodiment, controller 26 is further configured to store or allow user entry of a time value which has a predetermined relationship to an actual universal time value at which entry is being made or another already stored universal time value or elapsed time value, while not permitting entry of other time values. In still other embodiments, the controller may be configured to generate control signals causing the display of instructions on a display portion of input 24 prompting the user to input a time value having a predetermined relationship to such already stored time values. For example, the consumption of power to ready components 14 may exceed the power savings resulting from electronic device 10 being shut down when electronic device 10 is shut down for a relatively short period of time before being started up again. Controller 26 may be configured to not allow entry or the use of a time value for initiating the supply of power to ready components 14 which is not adequately spaced in time from the time at which electronic device 10 is initially shut down.

Actuator 28 comprises a device configured to actuate or change the state of switch 16 between the power transmitting on state and the off state. In one embodiment in which switch 16 comprises a mechanical electrical switch, actuator 28 may comprise a mechanical device such as a solenoid configured to mechanically move switch 16 in response to control signals from controller 26. In some embodiments, actuator 28 and switch 16 may be provided as part of a single component such as a semiconductor switching device (for example, a metal-insulator-metal device or a thin film transistor).

In operation according to one embodiment, a person may enter a readying start universal time value (e.g., 6:00 AM) which represents a universal time value at which the person desires the readying of components 14 for performing their functions to begin. Controller 26 stores or writes the received universal time value on memory 22. In particular applications, the universal time value may also represent a particular day, month and/or year value as well. While electronic device 10 is off such that power from power source 12 is not being transmitted to components 14 and such that components 14 are not ready to perform their functions, controller 26 continuously or periodically polls clock/timer 20 for a universal time value and compares the actual or measured universal time value with the stored universal time value on memory 22. When controller 26 receives an electrical signal from clock/timer 20 indicating an actual universal time value (e.g., 6:00 AM) that matches the stored universal time value on memory 22 (e.g., 6:00 AM), controller 26 generates control signals directing actuator 28 to actuate switch 16 to the on state. As a result, power from power source 12 is transmitted to components 14 to begin or initiate readying of component 14 to perform their noted functions. Once components 14 are readied to perform their noted functions, components 14 may perform their noted functions in response to further operator input received via input 24 or via another input source.

While electronic device 10 is in the off state, power control system 18 continues to receive power from power source 12. In other embodiments, power source 18 may alternatively receive power from auxiliary power source 13. This power is used for the operation of controller 26, clock/timer 20 and actuator 28.

In operation according to another embodiment, a person may enter or input a readying completion universal time value representing a universal time at which a person desires the readying of components 14 for performing their functions to be completed. For example, a person may wish components 14 of electronic device 10 to be ready for actual use no later than the beginning of a work day such as 8:00 AM. Based on this input universal time value at which the readying of components 14 is to be completed, controller 26 calculates or determines when the readying of components 14 would be initiated to accomplish this. In one embodiment, controller 26 consults memory 22 in which may be stored an expected amount of time used for the process of readying components 14. Controller 26 subtracts the expected amount of time which may be used by component 14 to be readied from the input readying completion universal time value at which the readying of components 14 is to be completed to determine the readying start universal time value at which the readying of components 14 is to begin. The readying start universal time value may then be stored in memory 22 by controller 26. For example, if the readying of components 14 takes a maximum time of 5 minutes and an operator or person has entered a readying completion universal time value of 8:00 AM for components 14 to be ready for operation, controller 26 may store the universal time value of 7:55 AM as the readying start universal time value at which the readying of components 14 should begin.

In particular embodiments, the expected or alternatively, maximum, time consumed during the readying of components 14 may be predetermined and pre-stored or pre-written in memory 22. In other embodiments, controller 26 may alternatively receive signals from one or more sensors indicating the actual start and completion of the readying of components 14. In such embodiments, controller 26 may be configured to calculate or determine and store on memory 22 the average, maximum or other value representing the time consumed during the readying of components 14. In such an embodiment, power control system 18 may more accurately and reliably complete the readying of components 14 at the desired time since data used to calculate the time at which readying would begin is based upon at least one actual previous time used by the particular electronic device 10 to ready components 14 rather than data that is generic to multiple electronic devices which may be inaccurate due to various individual factors such as different environmental operating conditions, manufacturing variances and the like.

Once controller 26 has calculated and potentially stored in memory 22 a readying start universal time value at which the readying of components 14 should begin, and while electronic device 10 is in the off state, controller 26 continuously or periodically polls clock/timer 20 and compares the actual universal time value received from clock/timer 20 with the stored universal time value in memory 22 which represents the time at which readying components 14 should begin. When such two values are equal, controller 26 generates control signals directing actuator 28 to actuate switch 16 to the on state. When switch 16 is actuated to the on state, power is transmitted from power source 12 to components 14, causing readying of components 14 for performing their functions to be begin.

In operation according to yet another embodiment, the person or operator may input a readying start an elapsed time value representing an amount of time that should lapse before the readying of components 14 is to begin. In one embodiment, tolling of the lapsed time value may begin when the lapsed time value is actually input. In another embodiment, the tolling of the lapsed time value may begin when electronic device 10 is shut down or otherwise actuated to an off state in which components 14 are no longer ready for performing their functions. In still other embodiments, the tolling of the lapsed time value may occur at other starting points.

According to one embodiment, controller 26 or input 24 may be configured to only allow user entry of lapsed time values or to only store elapsed time values that meet minimum threshold amounts of time for power consumption efficiencies. In other embodiments, the controller may generate signals causing the display of instructions on a display portion of input 24 prompting the user to only input an elapsed time value greater than a predetermined threshold time value. For example, the consumption of power used to ready components 14 may exceed the power savings resulting from electronic device 10 being shut down when electronic device 10 is shut down for a relatively short period of time before being started up again. Controller 26 and/or input 24 may be configured to not allow entry of elapsed time values which are less than a minimum amount of time at which electronic device 10 would be shut down for overall power consumption savings to be achieved. In one embodiment, controller 26 and/or input 24 may be configured to permit only elapsed time values of at least 1 hour. In another embodiment, only elapsed time values of 4 hours or 8 hours may be entered.

Once the elapsed time values have been received and written upon memory 22 by controller 26 and while electronic device 10 is shut down such that components 14 are no longer readied, controller 26 continuously or periodically polls clock/timer 20 for actual time amounts that have lapsed since the predetermined tolling start point. When the actual amount of time that has lapsed equals or exceeds the stored readying start elapsed time value in memory 22, controller 26 generates control signals directing actuator 28 to actuate switch 16 to the on state. Once switch 16 has been actuated to the on state, power from power source 12 is transmitted to components 14 causing the readying of components 14 to begin. Once the readying of components 14 has been completed, components 14 may perform their respective functions upon further operator or user input.

One example of the above-described mode of operation may be a person entering a lapse time value of 6 hours, wherein the tolling start point is when electronic device 10 is shut down. Once the person pushes a power switch shutting down electronic device 10, controller 26 generates control signals directing clock/timer 20 to begin counting or measuring time. Once controller 26 receives signals from clock/timer 20 indicating that 6 hours has passed, equaling the lapse time value of 6 hours in memory 22, controller 26 would then generate control signals directing actuator 28 to actuate switch 16 to the on state and to begin readying of components 14. In this scenario, if electronic device 10 were shut down at 11:00 PM, the readying of components 14 would begin at 5:00 AM. Alternatively, if electronic device 10 were shut down at midnight, the readying of components 14 would begin at 6:00 AM.

In operation according to yet another embodiment, electronic device 10 may alternatively prompt a person or operator to enter a readying completion elapsed time value representing an amount of time to be lapsed or tolled from a tolling starting point prior to the readying of components 14 being completed. In such an embodiment, controller 26 determines a readying start elapsed time value representing the amount of time that would lapse or be tolled from the tolling starting point prior to the readying of components 14 being started. In doing so, controller 26 subtracts a known or determined amount of time that is consumed by components 14 during their readying (stored on memory 22) from the input readying completion elapsed time value to calculate and potentially store a readying start elapsed time. Once this value is calculated and while electronic device 10 is shut down, controller 26 continuously or periodically polls clock/timer 20 for data regarding the amount of time that has lapsed since the tolling start point and compares this data to the readying start lapsed time value in memory 22. Once the actual lapsed time has exceeded or attained a predetermined relationship to the readying start elapsed time value in memory 22, controller 26 generates control signals directing actuator 22 to actuate switch 16 to the on state in which power is transmitted from power source 12 to components 14 to begin readying components 14.

Overall, power control system 18 enables electronic device 10 to be shut down with components 14 in a non-readied state for prolonged periods of time to conserve power consumption while, at the same time, enabling the components 14 to be immediately ready for use at a later operator determined time. As a result, users or operators are less likely to have to wait for components 14 to be readied and are more likely to shut down electronic device 10, conserving energy.

Figure 2:
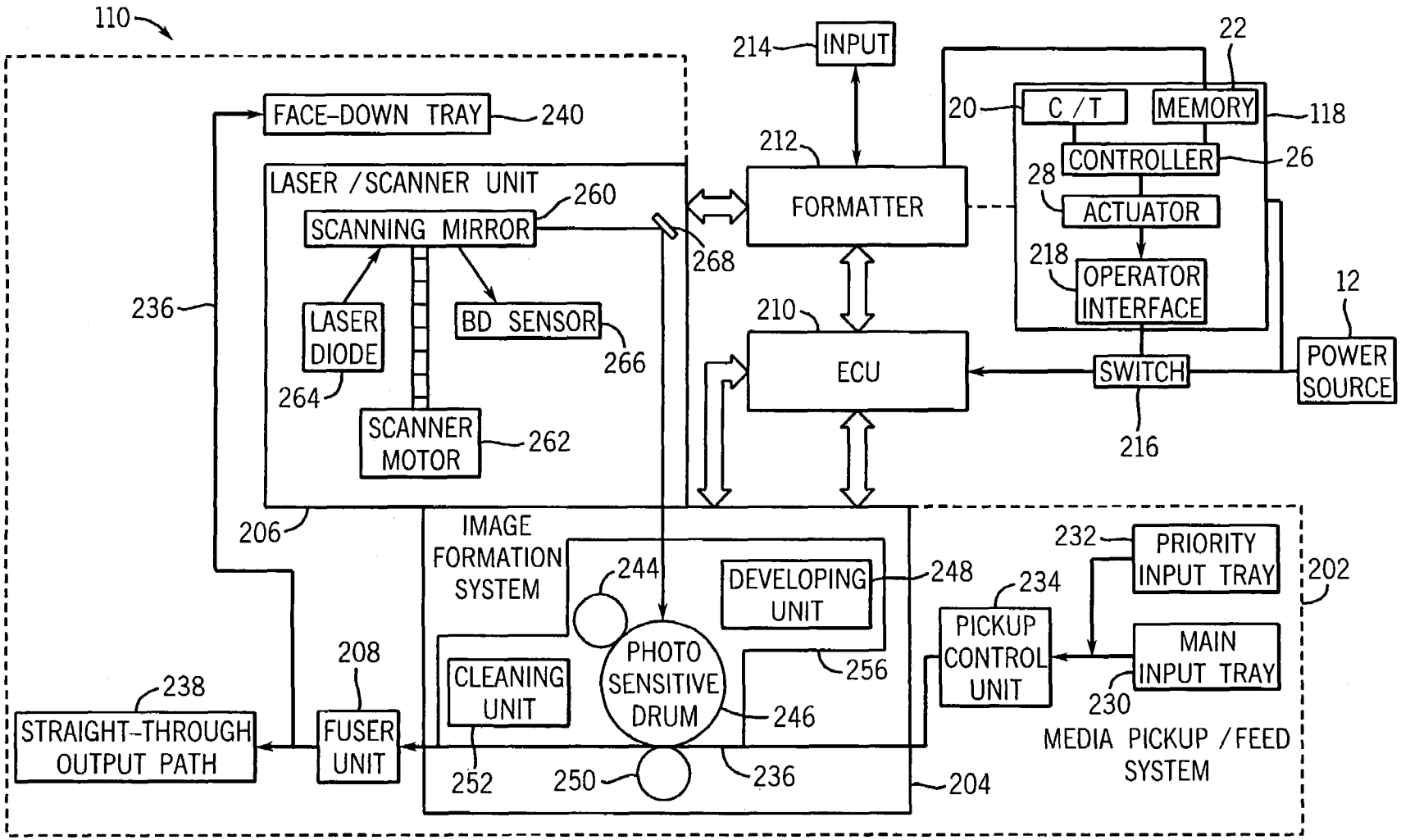
FIG. 2 is a schematic illustration of another embodiment of the electronic device of FIG. 1 according to one exemplary embodiment.
Figure 3:
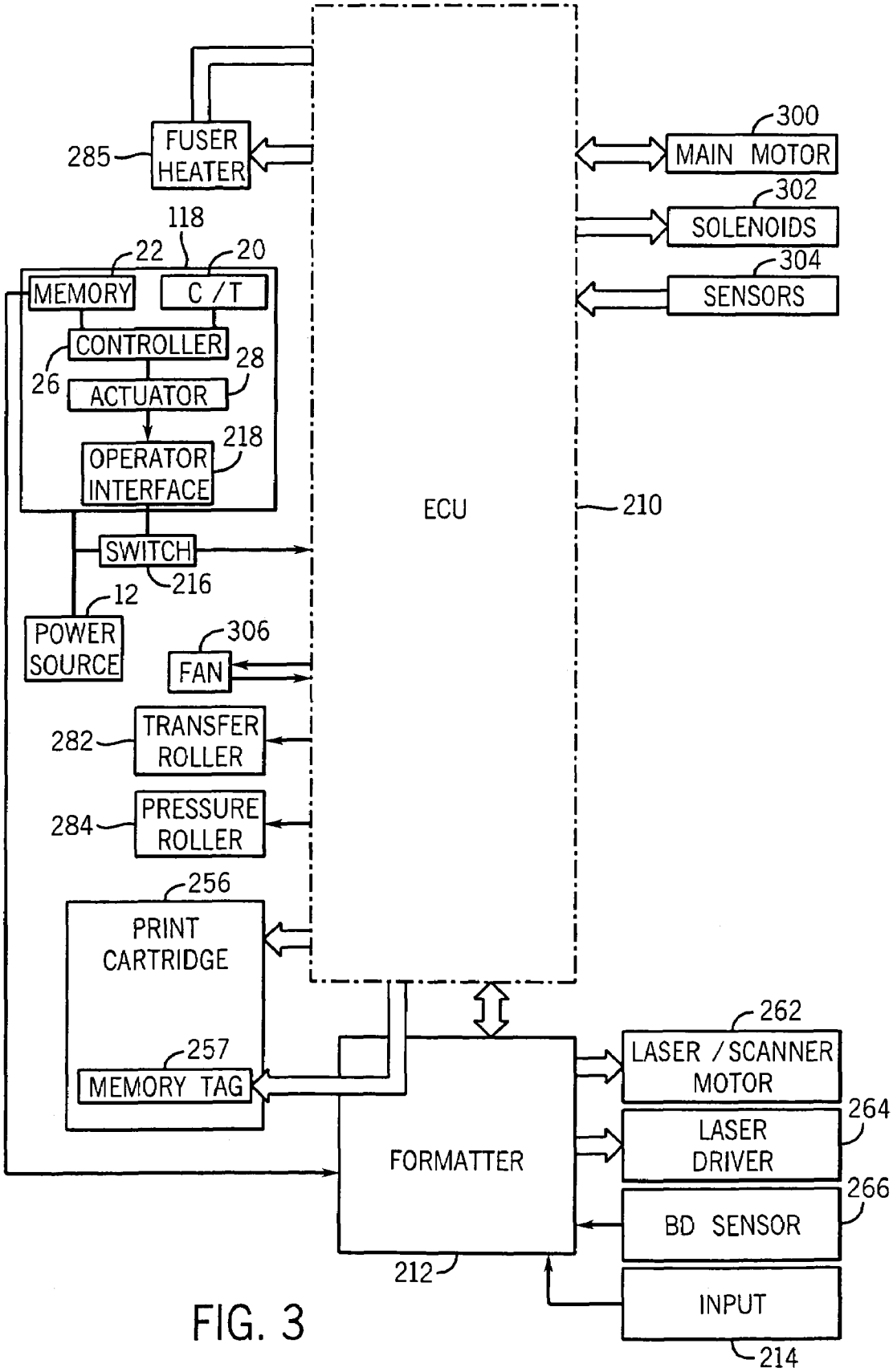
FIG. 3 is a schematic illustration of the electronic device of FIG. 2 according to one exemplary embodiment.

FIGS. 2 and 3 schematically illustrate electronic device 110, one embodiment of electronic device 10 including power control system 118, another embodiment of power control system 18. Electronic device 110 generally comprises an image-forming device configured to form or create a visual image upon a print medium. In the particular example shown, electronic device 110 comprises an electrophotographic or laser printer. In addition to power control system 118, electronic device 110 includes media pickup-feed system 202, image formation system 204, laser scanner unit 206, fuser unit 208, engine control unit 210, formatter 212, input 214, switch 216 and operator interface 218. Media pickup-feed system 202 generally comprises one or more mechanisms configured to receive, engage and transport print media through electronic device 110. System 202 generally includes input trays 230, 232, pickup control unit 234, transport system 236 and output trays 238, 240. In the particular embodiment shown, trays 230 and 232 comprise a main input and a priority input tray. Pickup control unit 234 comprises a unit including one or more belts or rollers configured to engage and move or pick up individual sheets, cards or other pieces from the stack of media contained and stored in either of trays 230, 232. Media transport 236 comprises a series of belts, rollers and the like configured to move the picked sheet or piece of media through image formation system 204 and through fuser unit 208 to one of output trays 238 and 240. Output tray 238 generally comprises a tray for receiving media that has been transported through a straight-through output path. In the particular example shown, output tray 240 comprises a tray configured for containing or storing media in a front-down orientation. In other embodiments, media pickup-feed system 202 may have various other configurations. For example, system 202 may alternatively include a greater or fewer number of such input trays or output trays, may include additional items configured for duplexing media or may include docks for receiving media containing cartridges.

Image formation system 204 generally comprises a system configured to apply printing material, such as toner, to the print media. In the particular example shown, image forming system 204 comprises an electrophotographic system. In other embodiments, image formation system 204 may alternatively comprise an inkjet image formation system. Image formation system 204 generally includes charging roller 244, photoconductive drum 246, developing unit 248, transfer roller 250 and cleaning unit 252. Charging roller 244 comprises a roller or drum configured to electrostatically charge a surface of photoconductive drum 246. Photoconductive drum 246 comprises a drum having a photosensitive surface configured to carry electrostatic charge and to be selectively discharged in response to photons of light received from laser scanning unit 206 to form an electrostatic image upon the surface of drum 246. In other embodiments, transferring charging roller 244 may be omitted and photoconductive drum 246 may alternatively comprise an electrographic surface which is configured to have particular portions selectively electrostatically charged to form an image upon its surface.

Developing unit 248 comprises a device configured to store and transfer printing material to the electrostatically charged surface of photoconductive drum 246. In one embodiment, developing unit 248 is configured to deposit dry toner particles to photoconductive drum 246. In another embodiment, developing unit 248 may alternatively be configured to apply liquid toner to photoconductor drum 246. In particular embodiments, the printing material may be itself electrostatically charged to facilitate transfer of the printing material to the surface of drum 246.

Transfer roller 250 comprises an electrostatically charged roller opposite to photoconductive drum 246. Drum 250 is electrostatically charged such that printing material carried by photoconductor drum 246 is transferred from drum 246 to media traveling between drum 246 and roller 250.

Although drum 246 and roller 250 are illustrated as cylindrical members, photoconductive drum 246 and transfer roller 250 may alternatively comprise electrostatically charged belts. Although photoconductive drum 246 is illustrated as being directly opposite to a sheet of print media, additional intermediate transfer members may alternatively be arranged between the photoconductive drum 246 (or belt) and the media being printed upon.

Cleaning unit 252 comprises one or more devices configured to clean any residual printing material, such as toner, from the surface of drum 246. In one embodiment, cleaning unit 252 is further configured to discharge any remaining charge from the surface of drum 246. In the particular embodiment shown, transfer charging roller 244, photoconductive drum 246, developing unit 248 and cleaning unit 252 are provided as part of a self-contained cartridge 256 which is removable from a body or housing containing the remaining components of electronic device 110. As shown by FIG. 3, cartridge 256 may additionally include a memory tag 257 comprising a memory in which is stored information regarding ink cartridge 256 and a printing material contained within cartridge 256.

Laser scanner unit 206 comprises a device configured to direct light upon the surface of photoconductor drum 246 to electrostatically discharge the selected portions of drum 246 so as to form an image. In the particular embodiment shown, unit 206 generally includes scanning mirror 260, motor 262, laser diode 264 and sensor 266. Motor 262 rotatably drives scanning mirror 260 as diode 264 emits light towards scanning mirror 264. This light is reflected or passes through various optics 268 so as to focus the light upon drum 246. Sensor 266 senses the light being reflected from mirror 260. In other embodiments, laser scanner unit 206 may have various other configurations. In still other embodiments, laser scanner unit 206 may be replaced with other devices configured to selectively direct light upon the surface of photoconductor drum 246, such as systems using liquid crystals to selectively block and transmit light on to photoconductor drum 246.

Fuser unit 208 comprises a device configured to fuse printing material applied to print media. As shown by FIG. 3, fuser unit 208 generally includes transfer roller 282 and pressure roller 284. Transfer roller 282 and pressure roller 284 are configured to engage print media passing therebetween. As shown by FIG. 3, unit 208 additionally includes a heater 285 for heating at least one of rollers 282, 284. At least one of roller 282 and roller 284 apply pressure and heat to the media to fuse the print material upon a surface of the media. Once the printing material has been fused to the surface of the print media, the print media is further transported by transport 236 to either output tray 238 or output tray 240.

Engine control unit 210 generally coordinates all print engine activities, drives laser scanner unit 206 and coordinates print data from formatter 212 with the image formation process carried out by image formation system 204. Engine control unit 210 further distributes power to each of the components of electronic device 110. Engine control unit 210 may also be referred to as a controller printed circuit assembly (PCA) or a direct current (DC) control PCA.

As further shown by FIG. 3, electronic device 10 additionally includes main motor 300, solenoids 302, sensors 304 and fan 306. Main motor 300 drives pick up control unit 234 and transport 236 of media pickup-feed system 202, drives the various components of image formation system 204 and drives one or both of transfer roller 282 and pressure roller 284 of fuser unit 208. Solenoids 302 actuate various components of electronic device 110. For example, solenoids actuate or engage a pickup control unit 234. Sensors 304 are located throughout electronic device 110 and sense the positioning or state of various elements of electronic device 110 as well as the positioning of media within device 110. Fan 306 is generally used to cool the internal components of device 110. In addition to coordinating print engine activities, driving laser scanner unit 206 and coordinating print data from formatter 212 with the image forming process carried out by image formation system 204, engine control unit 210 further distributes power to the various components. In the particular example shown, engine control unit 210 distributes distinct voltages, both direct current and alternating current, to distinct components of electronic device 110.

Formatter 212 generally comprises a processing unit in communication with engine control unit 210 and with input 214. Formatter 212 receives and processes print data received through an external port connected to an external source of data such as a camera, computer, network, internet and the like, or an internal source such as an internal memory card reader, optical disk reader and the like. Formatter 212 converts the image data into a dot image, wherein engine control unit 210 synchronizes image formation system 204 with media pick-feed system 202 and signals formatter 212 to send the print image data. Formatter 212 further monitors input 214. In some embodiments, formatter 212 relays printer status information to a controller panel associated either with electronic device 110 or a peripheral device.

Input 214 comprises a user interface in communication with formatter 212. In one embodiment, input 214 comprises a control panel configured as part of device 110. In another embodiment, input 214 may comprise another input device distinct from device 110 and in communication with formatter 212 such as a keyboard, mouse, microphone, touchpad and the like associated with a computer or other device in communication with electronic device 110. Similar to input 24 of electronic device 10, input 214 is configured to enable a person to enter a readying start or readying complete universal time value for use by power control system 218 to initiate the process of readying various components of electronic device 110 for use. In other embodiments, a readying start elapsed time value or a readying complete elapsed time value may be entered as discussed above. The input data is received by formatter 212 and is stored in memory 22 of power control system 118 by formatter 212.

Switch 216 comprises a mechanical switch actuatable between an on state in which power is transmitted from power source 12 to engine control unit 210 which distributes the power to the various components of electronic device 110 and an off state in which no power is transmitted to engine control unit 210. Operator interface 218 comprises a mechanical interface coupled to switch 216 and configured to enable an operator to actuate switch 216 between the on and off states. In one embodiment, operator interface 218 comprises a push button mechanically coupled to switch 216.

Power control system 118 comprises a system configured to initiate the readying of components of electronic device 110 at a predetermined universal time or after a predetermined lapse of time. Power control system 118 is substantially similar to power control system 18 (shown in FIG. 1) except that power control system 118 omits input 24 and utilizes input 214 associated with formatter 212. Power control system 118 further utilizes formatter 212 for receiving time values from input 214 and for writing or storing such time values in memory 22. In the particular example shown, actuator 28 of power control system 118 comprises a solenoid configured to engage operator interface 218 or a portion of operator interface 218 to actuate switch 216 to the on state and thereby initiate the readying of components of device 110.

Figure 4:
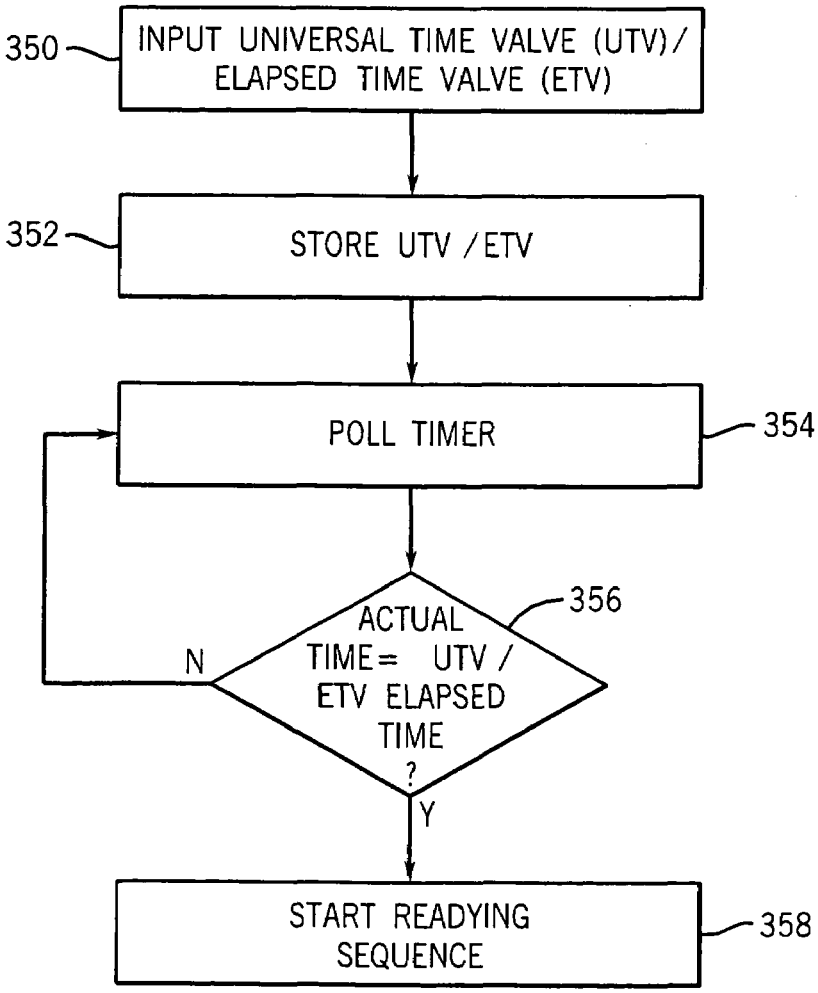
FIG. 4 is a chart illustrating an embodiment of initiation sequence for the electronic device of FIGS. 2 and 3 according to one exemplary embodiment.

FIG. 4 illustrates an exemplary process followed by power control system 118. As indicated by step 350, either a universal time value (UTV) or an elapsed time value (ETV), as described above with respect to FIG. 1, are input by input 214. As indicated by step 52, the input universal time value or input elapsed time value is then stored in memory 22. As indicated by step 354, while device 110 is generally powered down, controller 26 continues to poll the clock/timer 20. As indicated by step 356, controller 26 compares the actual time or the elapsed time value received from clock/timer 20 with the stored universal time value or the elapsed time value in memory 22. If the actual time or actual lapsed time is equal to the stored universal time value or the stored elapsed time value, respectively, controller 26 initiates or starts the readying sequence as indicated by step 358. Alternatively, if the actual time value or the actual elapsed time value does not equal the stored universal time value or the stored elapsed time value, respectively, controller 26 continues to poll clock/timer 20 as indicated by step 354.

Figure 5:
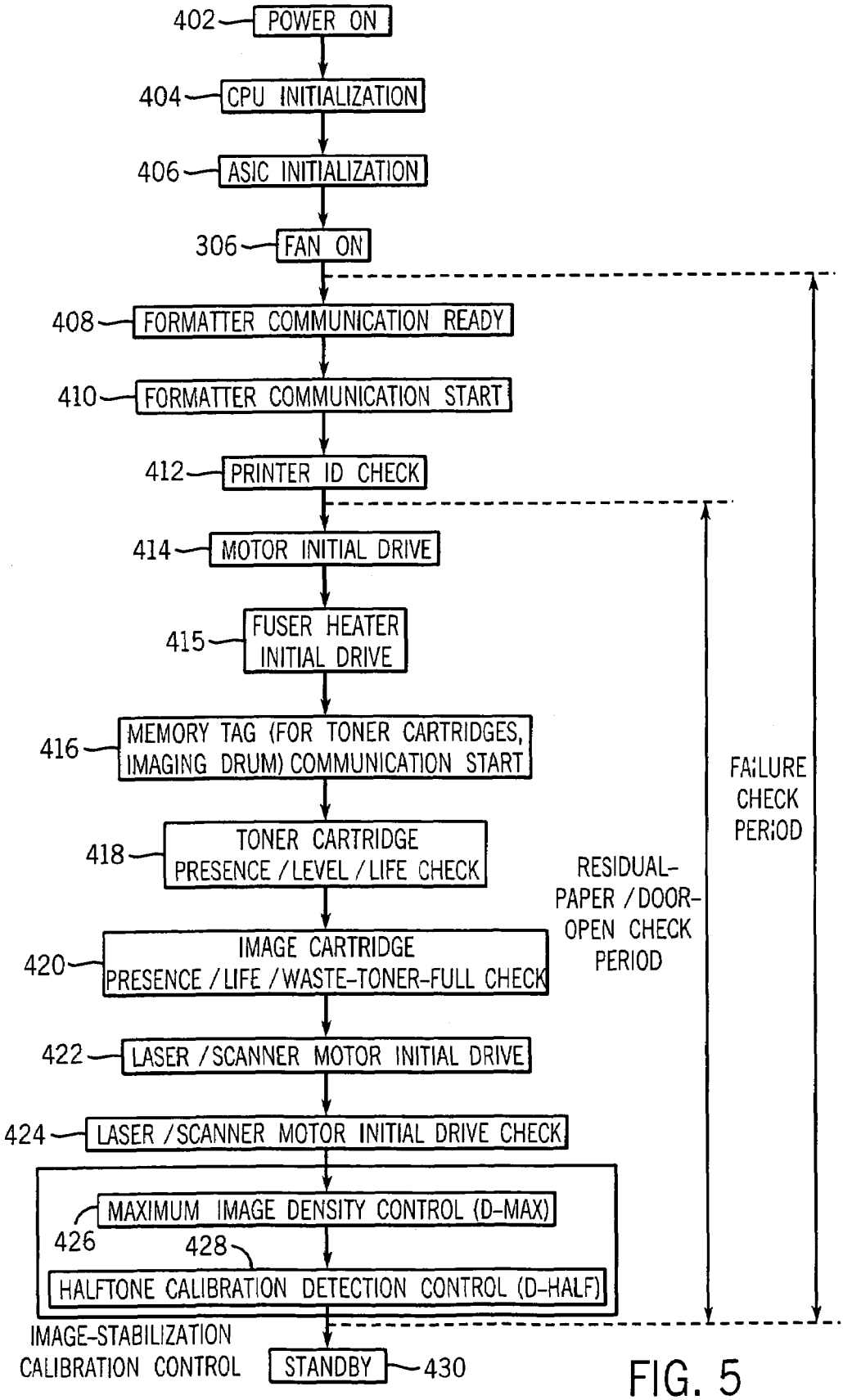
FIG. 5 is a chart illustrating an embodiment of a readying sequence for the electronic device of FIGS. 2 and 3 according to one exemplary embodiment.

Once controller 28 determines that the actual time value or the actual elapsed time has equaled the stored universal time value or the stored elapsed time value in memory 22, controller 26 initiates a power on or readying sequence. FIG. 5 illustrates an exemplary power on or readying sequence for electronic device 110 to ready the components of electronic device 110 for operation. As indicated by step 402, upon receiving power, engine control unit 210 initializes its processor and the various applications specific integrated circuits (ASIC) of electronic device 110 as indicated by steps 404 and 406. Engine control units 210 further powers fan 306 as indicated by step 306. In steps 408, 410 and 412, engine control unit 210 determines whether formatter 212 is ready for communication, initiates communication with formatter 212 and communicates the identification of the printer or electronic device 110 with formatter 212. As indicated by step 414, engine control unit 210 checks the status and working operation of main motor 300 and scanning motor 262. As indicated by step 415, engine control unit 210 further initially drives fuser heater 285. In the particular embodiment, engine control unit 210 controls its power distribution circuitry such that fuser heater 285 is heated to an initial surface temperature. In one embodiment, fuser heater 285 is heated to a surface temperature of approximately 100° C.

As indicated by step 416, 418 and 420, engine control unit 210 begins communication with memory tag 257 of print cartridge 256 to identify the presence or level of toner within cartridge 256 and to also evaluate the presence or level of waste toner within cartridge 256. As indicated by steps 422 and 424, engine control unit 210 evaluates the status and operability of its drive circuitry and the operability of scanning motor 262. As indicated by steps 426 and 428, engine control unit 210 further calibrates image formation system 204 to set a maximum image density and a half toning level. Once these readying steps are completed, electronic device 110 is in a readied or stand by mode, as indicated by step 430, waiting for further operator input to begin the use of the components of electronic device 110 to print upon print media.

Figure 6:
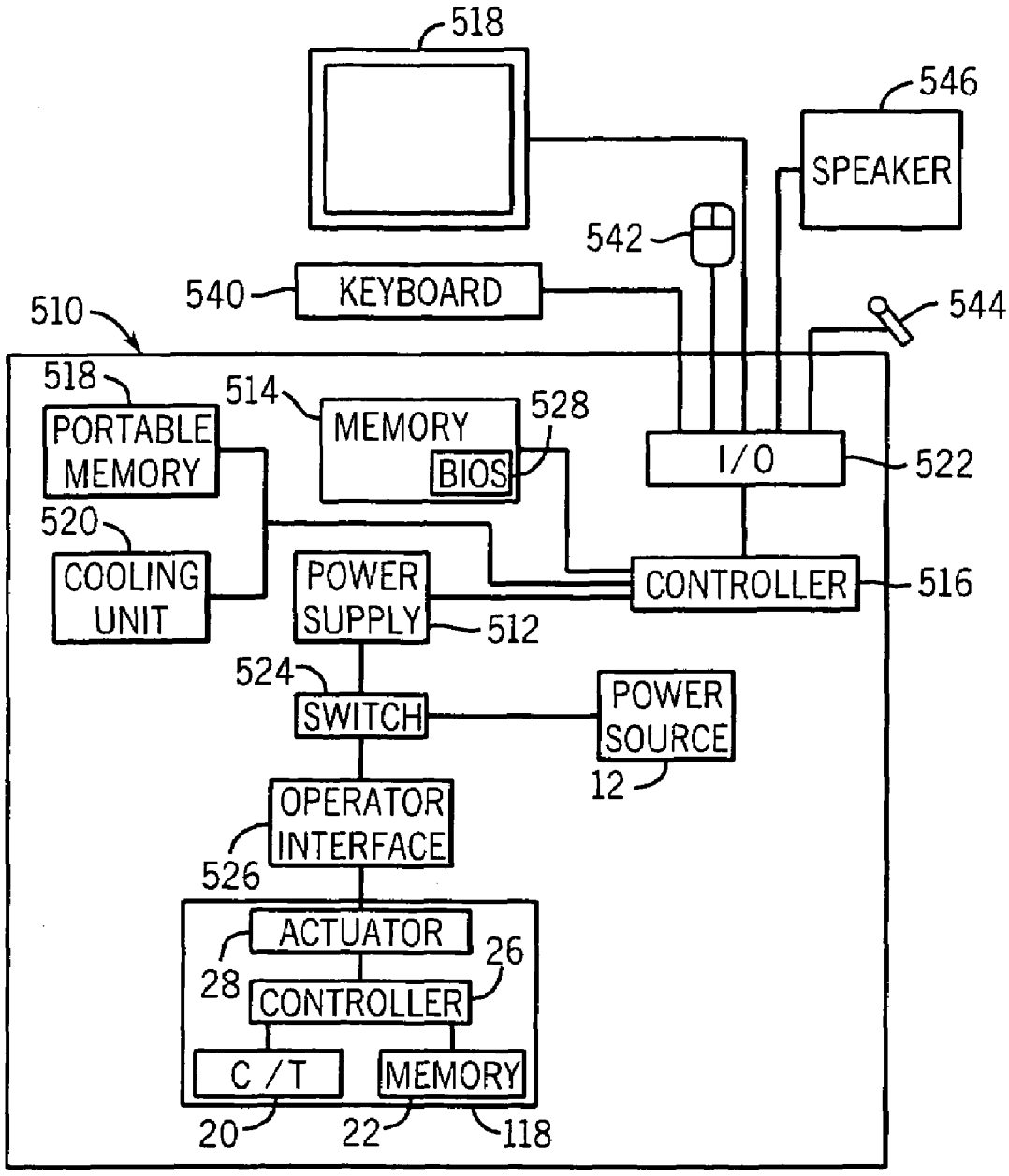
FIG. 6 is a schematic illustration of another embodiment of the electronic device of FIG. 1 according to one exemplary embodiment.

FIG. 6 schematically illustrates electronic device 510 incorporating power control system 118. Electronic device 510 comprises a computing system configured to manipulate data and/or store data in memory. In addition to power control system 118, computing system 510 generally includes the internal power supply 512, memory 514, controller 516, portable memory 518, cooling unit 520, input/output interfaces 522, switch 524 and operator interface 526. Internal power supply 512 generally comprises a power adapter configured to adapt and distribute power from power source 12 to the remaining components of device 510.

Memory 514 comprises one or more types of memory associated with device 10 configured to store various operating instructions for device 510 as well as to store data entered into device 10 through input/output interface 522 or manipulated by controller 516. Memory 514 may comprise read-only memory, random access memory or various other forms of persistent storage. Memory 514 includes a basic input/output system (BIOS) 528. BIOS 528 is generally written on flash memory and readies the remaining components of device 510 upon initial supply of power to device 510. In particular, upon the initial supply of power to device 510, BIOS 528 instructs controller 516 to check information stored in random access memory (RAM), such as a complementary metal oxide semiconductor (CMOS) chip, for detailed system information. BIOS 528 further loads interrupt handlers and device drivers, initializes registers and power management, conducts a power-on self-test for different hardware components to make sure such components are properly working, activates other BIOS chips on different cards installed in system 510, such as SCSI and graphics cards. BIOS 528 further manages various settings on system 510 such as settings for hard disks, internal clocks and the like. In addition, BIOS 528 initiates a bootstrap sequence for launching an operating system of system 510. In other embodiments, BIOS further contain instructions directing controller 516 to perform other functions for readying the components of electronic device 510.

Controller 516 generally comprises one or more processors associated with electronic device 510 and configured to generate control signals for directing the operation of various components of electronic device 510. Controller 516 may include one or more control processors configured to manipulate data as well as write or store data upon memory 514.

Portable memory 518 generally comprises one or more interfaces of device 510 configured to read and write upon portable memory devices such as optical disks, magnetic tapes or disks, memory cards and the like. Cooling unit 520 comprises one or more cooling fans configured to generate a flow of air through and within device 510 to cool components of device 510 such as power supply 512 and processing units of controller 516. Input/output interface 522 comprises an interface configured to enable device 510 to communicate with various input and output devices such as keyboard 540, mouse 542, microphone 544, speaker 546 and display/monitor 548. In one particular embodiment, memory 514, controller 516 and input/output interface 522 may be provided on one or more connected printed circuit boards.

Switch 524 comprises a mechanical switch configured to be actuated between an on state in which power from power source 12 is transmitted to power supply 512 and an off state. Operator interface 526 comprises a mechanical interface coupled to switch 524 and configured to enable a person to actuate switch 524 between the on and off states. In one embodiment, operator interface 526 comprises a power on button.

Power control system 118 is substantially identical to power control system 118 described with respect to electronic device 110. Power control system 118 automatically initiates the readying of the components of electronic device 510 based upon an input universal time value or an input lapsed time value entered via one of input devices 540, 542, 544 or other input devices and stored in memory 22 by controller 516. Controller 26 of system 118 periodically or continuously polls clock/timer 20 and compares such data with the previously entered universal time or lapsed time values. Once the actual universal time or lapsed time received from clock/timer 20 has a predetermined relationship with previously entered universal time value or lapsed time value, controller 26 generates control signals directing actuator 28 to engage operator interface 526 so as to actuate switch 524 to the on state. This results in power being transmitted to power supply 512 and to controller 516. In response, controller 516 operates according to instructions by BIOS 528 to perform the above-described readying sequence of checking CMOS set up for custom settings, loading interrupt handlers and device drivers, initializing registers and power management, performing the power-on self-test, and initiating a bootstrap sequence.

Like power control system 118 of system 110, power control system 118 of electronic device 510 automatically initiates the readying or "warm-up" of the various components of electronic device 510 at a predetermined time without further operator input. As a result, an operator using electronic device 510 may later arrive to find electronic device 510 in a stand by or ready mode, reducing the amount of time that the person would wait to use electronic device 510. As a result, the person using electronic device 510 may be more willing to completely shut down electronic device 510, such that the components of electronic device 510 are no longer readied and no longer consume power, at the end of a period of use to reduce power consumption.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An electronic device comprising:

a component;

a time measurement device;

an input device configured to receive a time value input from a user; and a controller configured (1) to determine an amount of time that the component will be unpowered based upon the time value input and a time at which supply of power to the component is terminated, (2) to compare the determined amount of time to a minimum threshold amount of time, and (3) to generate a signal based upon the time value input and input from the time measurement device to initiate supply of power to the component to ready the component to perform a function in response to further operator input if the determined amount of time is at least the minimum threshold amount of time, wherein the minimum threshold amount of time is a minimum amount of time at which power savings resulting from not supplying power to the component meet or exceed power consumed by readying the component.

2. The device of claim 1, wherein the component is configured to perform at least one of applying printing material to a medium, recording data on a memory medium and manipulating data.

3. The device of claim 1, wherein the component is configured to perform the at least one function of applying printing material to a print medium.

4. The device of claim 3, wherein the printing material comprises toner.

5. The device of claim 1, wherein the component is configured to perform the at least one function of recording data in the memory.

6. The device of claim 1, wherein the component is configured to perform the at least one function of manipulating data entered by an operator after the component is readied.

7. The device of claim 1, wherein the electronic device comprises a printer.

8. The device of claim 1, wherein the electronic device comprises a computer.

9. The device of claim 1, wherein the component includes a heater.

10. The device of claim 1, wherein the component includes a cooling fan.

11. The device of claim 1, wherein the component includes an electrostatic charge retaining surface.

12. The device of claim 1, wherein the component includes a motor operably coupled to media sheet driving members.

13. The device of claim 1, wherein readying the component includes calibrating the component.

14. The device of claim 1, wherein the input device is selected from a group of input devices consisting of:

a mouse;

a keyboard;

a touch pad;

a touch screen;

a microphone; and a push button.

15. The device of claim 1 including an actuator, wherein the actuator is configured to actuate a power switch in response to the signal.

16. The device of claim 15, wherein the actuator comprises a solenoid.

17. The device of claim 1 including an auxiliary power source configured to supply power to the time measurement device and the controller.

18. The device of claim 17, wherein the auxiliary power source includes a battery.

19. The device of claim 1, wherein the time measurement device comprises a clock.

20. The device of claim 1, wherein the controller is configured to store a universal time value.

21. The device of claim 20, wherein the controller is configured to store universal time values having a predetermined relationship with one of a current actual universal time and another stored universal time value.

22. The device of claim 1, wherein the time measurement device comprises a timer and wherein the time value input is an elapsed time value.

23. The device of claim 22, wherein the controller is configured to store the elapsed time value.

24. The device of claim 23, wherein the controller is configured to store an elapsed time value only greater than the minimum threshold value.

25. The device of claim 1, wherein the minimum threshold value is at least 1 hour.

26. The device of claim 1, wherein the minimum threshold value is at least 4 hours.

27. The device of claim 1, wherein the minimum threshold value is at least 8 hours.

28. The device of claim 1, wherein the time value input represents a time at which initiation of supply of power is to begin.

29. The device of claim 1, wherein the time value input represents a time at which readying of the component is to be completed.

30. The device of claim 29, wherein the controller is configured to store a time value representing time consumed for readying the component.

31. The device of claim 30, wherein the controller is configured to calculate the time value representing time consumed for readying the component based upon at least one actual sensed time for readying the component.

32. The device of claim 1, wherein the controller is configured to generate control signals causing a display to display instructions prompting a user to enter a time value input via the input device such that the amount of time that the component will be unpowered is at least the minimum threshold amount of time.

* * * * *